US005879846A

United States Patent [19]

Watanuki et al.

[11] Patent Number: 5,879,846

[45] **Date of Patent: *Mar. 9, 1999**

[54] IMAGE FORMING PROCESS AND APPARATUS

[75] Inventors: Tsuneo Watanuki; Satoshi Takezawa; Makoto Fukuda; Toru Takahashi; Norio Sawatari, all of Kawasaki, Japan

[73] Assignee: Fujitsu Limited, Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 663,520

[22] Filed: Jun. 13, 1996

[30] Foreign Application Priority Data

Oct. 13, 1995 [JP] Japan ..... 7-265354

[51] Int. Cl.[6] ..... G03G 15/74

[52] U.S. Cl. ..... 430/55; 430/31; 430/97; 430/66; 399/130; 399/159; 399/177

[58] Field of Search ..... 399/130, 159, 399/177; 430/31, 110, 97, 137, 55, 66

[56] References Cited

U.S. PATENT DOCUMENTS

| | | | |
|---|---|---|---|
| 3,674,736 | 7/1972 | Lerman et al. | 430/137 |
| 4,363,861 | 12/1982 | Nakamura et al. | 430/97 |
| 4,965,162 | 10/1990 | Aonuma et al. | 430/110 |
| 5,223,365 | 6/1993 | Yamamoto et al. | 430/137 |
| 5,432,033 | 7/1995 | Asanae et al. | 399/130 |

FOREIGN PATENT DOCUMENTS

| | | |
|---|---|---|
| 62-229260 | 8/1987 | Japan . |
| 2-101474 | 4/1990 | Japan . |
| 2-221965 | 9/1990 | Japan . |
| 3-68956 | 3/1991 | Japan . |
| 6-301300 | 10/1994 | Japan . |

*Primary Examiner*—Christopher D. Rodee

*Attorney, Agent, or Firm*—Armstrong, Westerman, Hattori, McLeland & Naughton

[57] ABSTRACT

A developing agent comprises an insulative toner and a conductive carrier, and the tensile rupture stress of the insulative toner powder layer is 0.1–1 g wt/cm$^2$. The insulative toner used is insulative magnetic toner to which hydrophobically treated inorganic particles and conductive particles have been externally added.

10 Claims, 1 Drawing Sheet

IMAGE FORMING PROCESS AND APPARATUS

BACKGROUND OF THE INVENTION

1. Field of the Invention

The present invention relates to an image forming process and apparatus, and particularly to a recording process by which the back of a photoconductor is exposed to light for almost simultaneous development, in order to achieve improved image quality.

2. Description of the Related Art

Current copying machines and page printers generally employ an electrophotographic recording system. This system uses a photoconductor as the recording medium, and usually involves the Carlson process by which recording is accomplished through 7 steps including uniform charging, image exposure, development, transfer, fixing, static elimination and cleaning. The charging produces a uniform positive or negative static charge on the surface of a photoconductive photoconductor, and in the subsequent exposure process laser light, etc. is irradiated to remove the surface charge on specific sections, thus forming on the photoconductor a static latent image corresponding to the image information. Next, the latent image is electrostatically developed with toner, to form a visible image on the photoconductor with the toner, and finally the toner image is electrostatically transferred to recording paper and fused therewith by heat, light, pressure, etc. to obtain a print. However, in conventional recording apparatuses which employ the Carlson process, the means used for each step are positioned around the photoconductor, and therefore when the apparatus is downsized the means for each step become closely arranged around the photoconductor. This has resulted in the disadvantages that downsizing may be accomplished only to a limited degree and that scattering of the developing agent from the developing device contaminates the optical system used in the image exposure means, thus adversely affecting the printing.

In light of these disadvantages there has recently been proposed an image exposure process in which the image exposure light source is located inside the photoconductor, and light is irradiated from behind the photoconductor opposite the developing device, to complete recording in the width of contact between the developing agent and the photoconductor (for example, Japanese Unexamined Patent Publication No. 58-15395 and No. 57-119375).

This principle will now be explained.

FIG. 1 shows the construction of an apparatus for the process described above. The photoconductor 1 is composed of a transparent substrate 1*a*, a transparent conductive layer 1*b* and a photoconductive layer 1*c*, and the transparent conductive layer is grounded. The developing roller is provided with a conductive sleeve on an anchored magnetic roller. A low resistance carrier and insulative toner are used as the developing agent 4. The developing agent is attracted to the developing roller by magnetic force, and is carried to the photoconductor while adhering to the surface of the sleeve. The following three steps are then carried out inside the developing nip in rapid succession. The photoconductor is charged with the developing agent by the bias voltage applied to the developing roller. Image exposure is accomplished on the charged photoconductor from the transparent substrate side to form a latent image. The toner is developed on the exposed sections by inverted development. The developed toner is then transferred to recording paper 5 or a plastic plate to obtain a print. Hereunder this process will be referred to as the "back-light process", because the photoconductor is exposed to light from the back side.

The back-light process is based on a simple image forming principle, and the low number of parts makes it very effective for downsizing of the apparatus.

The back-light process, however, produces lower image quality than the Carlson process, and of particular consideration is the tendency toward staining of the print background, known as fogging.

In particular, since the developing principle of the back-light process inevitably causes the surface potential of the photoconductor drum to be either the same as the developing bias or slightly lower due to efficiency loss, toner tends to adhere to the non-image sections outside the latent image, causing fogging, and such development is even more likely in a low-humidity environment in which the toner charge amount is higher.

In order to reduce fogging the toner charge amount must be kept low, and thus Japanese Unexamined Patent Publication No. 59-88751 discloses a back-light process employing conductive toner. Since the toner is conductive, the surface potential of the photoconductor drum is lowered in the non-image sections, and since the toner charge amount is lowered, the recovery is improved.

Nevertheless, the conductivity of the toner in this process creates the disadvantage of lower transfer efficiency in corona or roller systems.

Thus, the present invention has been accomplished using an insulative toner with high transfer efficiency to reduce fogging.

Numerous processes have already been reported wherein insulative toner is used for back-light development.

One process, proposed in Japanese Unexamined Patent Publication No. 61-46961, deals with the problem from the apparatus end by employing two electrodes, a charging bias electrode and a developing bias electrode. This, however, complicates the construction of the apparatus, and thus constitutes an obstacle to downsizing and simplification, which were the original advantages of the back-light process.

On the other hand, as a solution from the carrier end, there is disclosed, in Japanese Unexamined Patent Publication No. 5-119541 and elsewhere, a process whereby the developing agent resistance is lowered by conductive treatment of the carrier surface, in order to raise the surface potential of the photoconductor drum and thus reduce fogging. Since the photoconductor drum is charged via the developing agent in the back-light process, lowering the resistance of the carrier is highly effective for achieving higher picture quality. However, when using a developing agent which is mixed with the insulative toner at a high toner concentration, the resistance of the developing agent eventually increases, and thus no effect is obtained.

DESCRIPTION OF THE INVENTION

The present invention provides an image forming process which employs an image forming apparatus comprising a photoconductor formed by successively laminating a conductive layer of a light-transmitting material and a photoconductive layer on a substrate of a light-transmitting material, developing means situated on the photoconductive layer side of the photoconductor for transporting the developing agent to contact it with the photoconductor and for applying a voltage, and light exposure means situated on the substrate side of the photoconductor opposite the developing means for exposure of an image on the photoconductor wherein, within the contact width between the photoconductor and the developing agent, a voltage is applied between the photoconductive layer and the developing agent and the photoconductive layer is exposed to light from the light exposure means, characterized in that the developing agent comprises an insulative toner and a conductive carrier, and the tensile rupture stress of the insulative toner powder layer is 0.1–1 g wt/cm$^2$.

The tensile rupture stress referred to here is the maximum stress which fractures a toner cake made by applying appropriate pressure to toner powder, and may be measured using, for example, a Powderbed tester (Sankyo Piotech). The pressure load is set to 100–200 g wt/cm$^2$. The porosity of the toner powder layer is about 0.5–0.6.

Non-magnetic toner, and especially non-magnetic color toner, may be employed if the photoconductor used is formed by successively laminating a conductive layer made of light-transmitting material, photoconductive layer and surface insulating layer, on a substrate made of a light-transmitting material.

The surface insulating layer preferably contains a compound which is charged to the same polarity as the toner with respect to the carrier. Specifically, it is ideal to form a surface insulating layer made of one or a mixture of resins such as a cyanoethylated polysaccharide, cyanoethylated polyvinyl alcohol, etc. with strongly electron-attracting side chains, on an organic photosensitive layer used at negative polarity, and to use negative charging toner, with further addition of an isocyanate compound for thermal curing of the surface insulating layer. A so-called charge control agent compound may also be added. In this case, a surface insulating layer of a resin containing a positive charge control agent is formed on a positive polarity photoconductor and positive charged toner is used, or a surface insulating layer of a resin containing a negative charge control agent is formed on a negative polarity photoconductor, and negative charged toner is used. The binder resin is preferably cured by light or heat.

As a result of studying toner which easily adheres to background sections, it was found that fine toner of 5 $\mu$gm or less produces a particularly large degree of adhesion. Thus, suitable insulative toner has an average particle size of 6–12 $\mu$m, and 15% or fewer particles of 5 $\mu$m or less. This is assumed to be because small toner particles not only have a larger $\sigma$, but also a higher toner specific charge, and thus also electrostatically, have a greater tendency to adhere to the photoconductor surface.

In addition, insulative organic or inorganic fine particles are added externally to the insulative toner, and the fine particles are preferably on the surface of the toner at a coating ratio of 0.5–1. The externally added fine particles may be either one type or a mixture of inorganic fine particles of hydrophobic silica, or titanium oxide, aluminum oxide or the like with a primary particle size of about 10–30 nm, or other publicly known particles such as carbon or resin fine particles. The coating ratio E mentioned here may be approximated as $E=(D\cdot c)/(4\cdot d)$ when sufficiently small fine particles (particle size d) with respect to the toner particle size D are externally added at a volume ratio c. If the coating ratio E is too low $\sigma_\tau$ becomes larger, and when E exceeds 1 $\sigma_\tau$ changes little but the externally added fine particles are easily disassociated from the toner creating the inconvenience of loss of toner fixation.

The total volume resistance ratio of the developing agent is preferably about $10^{10}$ $\Omega\cdot$cm or less, because if the developing agent resistance is too high the charge injection electrification from the developing agent to the photoconductor is insufficient, tending to result in background staining.

Furthermore, when conductive particles are externally added with the insulative organic or inorganic particles to the insulative toner used for development, a greater effect of reducing background staining is achieved, as well as a notable effect of preventing fogging under low-humidity conditions.

The reason for this may be explained as follows. As shown in Table 5, even when conductive particles are externally added, there is virtually no reduction in the loss permittivity of the toner or the resistance of the developing agent. In other words, the method differs from publicly known methods in that the insulating property of the toner is maintained while the developing agent resistance is lowered, and thus the surface potential of the photoconductor drum is raised, preventing fogging. As a result, the problem of lower toner transferability does not occur.

On the other hand, as shown in Table 4, if the amount of the externally added conductive particles is increased, the charge amount distribution of the toner tends to become sharper. Thus, it is believed that the presence of the conductive particles results in leaking of the charge of the excessively electrified toner to create a uniform charge amount distribution, and thus reduce fogging.

The electrical resistance of the conductive particles should be $10^5$ $\Omega\cdot$cm or less. The electrical resistance here is measured in a pressure cell under a pressure of 200 kg/cm$^2$ and an applied voltage of 500 V. Powder with an electrical resistance of $10^4$ $\Omega\cdot$cm or lower is generally referred to as being conductive particles, considering that the external additive such as hydrophobic silica or titanium oxide which is used as the external additive in the toner has an electrical resistance of $10^9$ $\Omega\cdot$cm or greater, and in most cases $10^{10}$ $\Omega\cdot$cm or greater.

The particle size of the conductive particles is preferably 0.6 $\mu$m or less. The addition of the same amount of larger particles results in a diminished effect of reducing fogging. This is believed to be because, when added in the same amount, larger sized particles reduce the coating ratio of the toner surface.

The material for the conductive particles which may be used according to the invention is not particularly limited, but suitable examples are carbon, magnetite, tin oxide-based composite oxides, conductive titanium oxide prepared by treating the surface of titanium oxide with a tin oxide-based semiconductor, and conductive barium sulfate or the like prepared by treating the surface of barium sulfate with a tin oxide-based semiconductor. However, to the knowledge of the present inventors among external additives with resistances in the range of $10^4$ $\Omega\cdot$cm–$10^9$ $\Omega\cdot$cm there are no appropriate samples which may be applied as external additives to toner, and because experimentation could not be carried out, no mention thereof is made in the claims of the present invention; however, it must be noted that the possibility remains of applicability to the present invention even with a particle resistance in the range of $10^4$ $\Omega\cdot$cm–$10^9$ $\Omega\cdot$cm.

The amount of the conductive particles externally added to the toner should be 1 wt% or less. If the amount of external addition exceeds this, the toner charge amount is drastically reduced, not only leading to poor transfer, but also having an adverse influence on the fixing properties.

The loss permittivity of the above-mentioned insulative toner is preferably between 0.1 and 1, and more satisfactory images are obtained when the loss permittivity is between 0.2 and 0.6. This is presumed to be because an overly elevated amount of resistant components in the toner produces excessively charged toner which tends to adhere to the background sections. When the loss permittivity is too high, there is more leaking of the toner charge, which results in lower transfer characteristics and other inconveniences.

The insulative toner to be used according to this design may be produced by a known method such as a pulverizing method, a suspension polymerization method described in, for example, Japanese Examined Patent Publication No. 36-10231 or No. 51-14895, or Japanese Unexamined Patent Publication No. 62-297855, or an emulsion polymerization condensation method such as described in detail in, for example, Japanese Unexamined Patent Publication No. 63-186253 and No. 63-282749. In the case of toner obtained by pulverizing, it is preferably made spherical after production by heat treatment or the like, to reduce $\sigma_r$. Methods for obtaining spherical toner include methods in which the aging during suspension polymerization or emulsion polymerization is prolonged, and methods in which common pulverized toner is made spherical using a hybridizer (Nara Instruments) or an apparatus for mechanofusion (Hosokawa Micron, KK.) or suffusing (Nihon Pneumatic), etc., or in which the toner is made spherical by dispersion in water and heating (at about the Tg temperature of the binder resin). The toner binder used may be a known one such as a styrene-acryl resin, polyester resin or epoxy resin, and if necessary magnetic fine particles, carbon, dyes, waxes, etc. may also be added.

The conductive carrier may be iron powder, magnetite powder, ferrite powder or particles thereof coated with a resin or the like, or a so-called resin carrier wherein magnetic particles are dispersed in a resin.

The electrical resistance of the carrier is preferably $10^7$ Ω·cm or less. Since in the back-light process the photoconductor drum is charged through the developing agent, a high carrier resistance results in a high developing agent resistance, which lowers the surface potential of the photoconductor drum and leads to increased fogging. Also, the specific surface area of the carrier is preferably as large as possible. This is because developing agents with the same toner concentration have lower toner coating ratios on the carrier surface as their specific surface area increases, and this leads to more direct contact between the carrier, which lowers the developing agent resistance and increases the charging efficiency of the photoconductor drum.

The substrate used according to the invention which is formed of a light-transmitting material may be any known one such as, for example, a glass cylinder, a transparent resin cylinder or a transparent resin film. The conductive layer formed of a light-transmitting material may be an ITO deposition film, a conductive polymer film, or the like. Also, the photoconductive layer used may be an inorganic photoconductive layer such as "amorphous silicon", or a multilayer-type or monolayer-type organic photoconductive layer.

The light exposure means situated on the substrate side opposite the developing means for light exposure of an image on the photoconductor may be an LED array, a liquid crystal shutter array, a semiconductor laser optical system, or the like. There may also be provided means for transferring the toner powder image onto paper or another medium using a corona transfer device or roller transfer device, and means for fixing the transferred image by heat, pressure, etc. FIG. 1 shows an example of a construction of such an apparatus.

EXAMPLES

Figure 1:
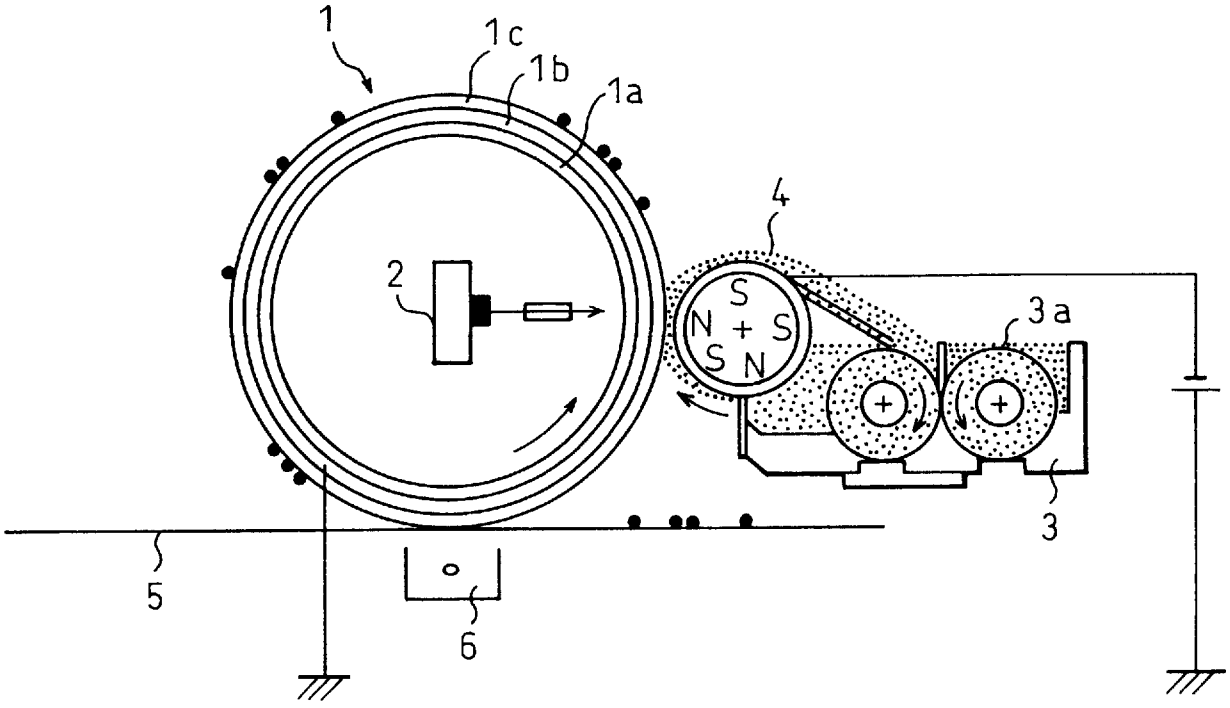
FIG. 1 shows an apparatus for the back-light process.

The following examples serve as a concrete explanation of the present invention, but the invention is in no way limited thereto.

Example 1

(Test production of photoconductor)

An ITO deposition glass cylinder was successively immersion-coated with an approximately 1 μm intermediate layer made of cyanoethylated pullulan, an approximately 0.2 μm charge generating layer made of oxotitanylphthalocyanine and a polyvinyl formal resin, and an approximately 20 μm charge transport layer composed mainly of a butadiene derivative and a polycarbonate resin, to obtain a photoconductor drum A.

(Test production of toner)

After thorough stirring and mixture of 80 parts by weight of styrene, 20 parts by weight of butyl acrylate and 5 parts by weight of acrylic acid, the mixture was charged into 100 parts by weight of distilled water containing 2 parts by weight of an emulsifier and 0.5 part by weight of a polymerization initiator, and polymerization was conducted at 70° C. while stirring to obtain an emulsion containing fine particles approximately 0.2 μm in size. Next, 50 parts by weight of the obtained emulsion in terms of solid content, 40 parts by weight of magnetite powder (particle size approximately 0.5 μm) and 3 parts by weight of a polypropylene resin (Biscoru 550P, Sanyo Kasei) were stirred in 400 parts by weight of distilled water. The mixture was stored (aged) for 4 hours at 90° C. while dispersing and stirring, and after cooling the mixture, the product was filtered and washed and dried to obtain particles with an average particle size of about 9 μm and a BET specific surface area of 0.5 $m^2/g$. Hydrophobic silica (H2000/4, product of Hoechst) was then externally added at a coating ratio of 1 to obtain toner 1. A Powderbed tester (product of Sankyo Piotech) was used to measure the tensile rupture stress. A toner cake of toner 1 was prepared with a precompaction load of about 150 $g/cm^2$, and the tensile rupture stress was measured to be about 0.7 g $wt/cm^2$. Also, the loss permittivity of the toner was about 0.2, and was virtually the same before and after external addition of the hydrophobic silica. It was then mixed with a silicone resin-coated sheet-like iron powder carrier (product of Hitachi Metals) with an average particle size of approximately 30 μm and an electrical resistance of about $10^5$ Ω·cm, to a toner concentration of 10 wt %, as the developing agent for Example 1. The developing agent resistance was about $10^9$ Ω·cm.

The test printing apparatus shown in FIG. 1 was used for a printing test. The processing speed was 25 mm/s, the circumferential speed ratio between the developing sleeve and the photoconductor drum was 3 (same direction) and the developing bias was −600 V. As a result, satisfactory images were obtained with high printing density and no background staining.

Example 2

A test sample of toner 2 was prepared in exactly the same manner as in Example 1, except that the hydrophobic silica (H2000/4, product of Hoechst) was externally added at a coating ratio of 0.6. The tensile rupture stress was virtually identical, and the printing test yielded similarly satisfactory images.

Comparative Example 1

A test sample of toner 3 was prepared in exactly the same manner as in Example 1, except that the hydrophobic silica (H2000/4, product of Hoechst) was externally added at a coating ratio of 0.3. The tensile rupture stress was about 1.5 g wt/cm$^2$. In the printing test, the image density was sufficient, but background staining was produced.

Comparative Example 2

A test sample of toner 4 was prepared in exactly the same manner as in Example 1, except that the hydrophobic silica (H2000/4, product of Hoechst) was externally added at a coating ratio of 1.5. The tensile rupture stress was measured to be about 0.7 g wt/cm$^2$, or almost identical, and the printing test yielded similarly satisfactory images. Some problem occurred, however, with peeling of the fixed image.

Comparative Example 3

The same polymerization method as in Example 1 was used to obtain particles with an average particle size of about 8 $\mu$m and a BET specific surface area of 1.4 m$^2$/g. Hydrophobic silica was externally added to a coating ratio of 0.8 to obtain toner 5. The tensile rupture stress was about 1.3 g wt/cm$^2$, and the loss permittivity of the toner was about 0.2. In the printing test, the image density was sufficient, but background staining was produced.

Comparative Example 4

After melting and kneading 50 parts by weight of a styrene-acryl resin (styrene, butylacryl ratio 8:2), 40 parts by weight of magnetite powder (particle size approximately 0.5 $\mu$m) and 3 parts by weight of a polypropylene resin (Biscoru 550P, Sanyo Kasei), the mixture was pulverized and sorted to obtain particles with an average size of about 9 $\mu$m. Hydrophobic silica was externally added to a coating ratio of 0.8 to obtain toner 6. The tensile rupture stress was about 2.7 g wt/cm$^2$. The loss permittivity of the toner was about 0.05. In a printing test carried out in the same manner as Example 1, considerable background staining was produced.

Example 3

A suffusion apparatus (product of Nihon Pneumatics) was used for hot air treatment of the pulverized particles obtained in Comparative Example 4. Hydrophobic silica was externally added to a coating ratio of 0.8 to obtain toner 7. The tensile rupture stress was smaller at about 1 g wt/cm$^2$, and in a printing test carried out in the same manner as Example 1, the background staining was reduced and the image quality was generally improved. In addition, tin-coated titanium oxide particles (average size approximately 0.2 $\mu$m) were externally added to the toner at 0.5 wt % to obtain toner 7'. The printing test resulted in no visible background staining, for an even more satisfactory image.

Example 4

Forty parts by weight of styrene, 13 parts by weight of butyl acrylate, 1 part of an azo chrome dye (S34, product of Orient), 40 parts by weight of magnetite powder (particle size approximately 0.5 $\mu$m), 3 parts by weight of a polypropylene resin (Biscoru 550P, Sanyo Kasei) and 1 part by weight of a polymerization initiator were mixed and dispersed to obtain a monomer composition. The monomer composition was then charged into 500 parts by weight of a 30 ppm aqueous sodium dodecylbenzenesulfonate solution which had dissolved 10 parts by weight of tricalcium phosphate as a dispersing agent, and the resulting suspension was then heated at 80° C. for polymerization. After cooling, the product was filtered, washed and dried to obtain spherical particles with an average particle size of about 10 $\mu$m. Hydrophobic silica (H2000/4, product of Hoechst) was externally added to a coating ratio of 0.8 to obtain toner 8. The tensile rupture stress was measured to be about 0.6 g wt/cm$^2$. The loss permittivity of the toner was about 0.5.

In a printing evaluation in the same manner as Example 1, satisfactory images were obtained.

Comparative Example 5

Spherical toner 9 with an average particle size of about 6 $\mu$m was obtained by polymerization in the same manner as Example 4. The tensile rupture stress was about 1.1 g wt/cm$^2$, and the percentage of particles size 5 $\mu$m or less was about 20 wt %. In a printing test, slight background fogging occurred. The particle size of the toner adhering to the background sections was determined, and it was found that the percentage of particles sized 5 $\mu$m or less was about 1.5 times greater.

Example 5

The particles obtained in Comparative Example 5 were sorted and the fine powder was cut to lower the percentage of particles sized 5 $\mu$m or less to about 10 wt % (toner 10). The rupture stress fell to about 0.9 g wt/cm$^2$. Also, in the printing test the background staining was reduced and satisfactory images were obtained. Thus, a lower percentage of particles sized 5 $\mu$m or less is preferred.

Comparative Example 6

A silicone resin-coated sheet-like iron powder carrier (product of Hitachi Metals) with an average particle size of approximately 30 $\mu$m and an electrical resistance of about $10^7$ Ω·cm was used for Example 1, and mixed with toner 1 to a toner concentration of 20 wt %, to prepare the developing agent for Comparative Example 6. The developing agent resistance was about $10^{11}$ Ω·cm. In the printing test, considerable background staining was produced.

Example 6

A printing test was conducted in exactly the same manner as Comparative Example 6, except that the toner 8 of Example 4 was used. The developing agent resistance was about $5\times10^{10}$ Ω·cm. In the printing test, there was a tendency to less background staining. In addition, when tin-coated titanium oxide particles (average size approximately 0.2 $\mu$m) were externally added to the toner at 0.5 wt %, the loss permittivity increased from 0.5 to about 0.8, and the developing agent resistance was about $10^{10}$ Ω·cm. In the printing test, background staining disappeared and satisfactory images were obtained. Thus, a larger loss permittivity of the toner is preferred, and in particular external addition of fine particles which increase the loss permittivity is appropriate. Also, the developing agent resistance is preferably about $10^{10}$ Ω·cm or less.

The results described above are listed in Table 1. They demonstrate that a smaller tensile rupture stress of the toner results in less background staining, and satisfactory images are obtained if it is about 1 g wt/cm$^2$. It is also shown that a coating ratio of the fine particle external additive is preferably about 0.5–1.

It is clear that for a more notable effect of the present invention, the percentage of particles sized 5 $\mu$m or less is preferably lower, and suitably about 15% or lower, the loss permittivity of the toner is preferably larger, with external addition of fine particles which increase the loss permittivity being particularly suitable, and the developing agent resistance is preferably lower, with about $10^{10}$ Ω·cm or less being preferred.

Examples 7 and 8

(Test production of photoconductor)

The photoconductor drum A of Example 1 was further coated with an insulating layer comprising 95 parts by weight of cyanoethylated pullulan, 5 parts by weight of cyanoethylated polyvinyl alcohol (both products of Shinetsu Chemical) and 1 part by weight of blocked polyisocyanate (B1370, product of Dicell Fuels), to prepare a photoconductor drum B.

A photoconductor drum A was also coated with an insulating layer comprising 20 parts by weight of a negative charging azo chrome dye (S34, product of Orient) and 80 parts by weight of a polyvinyl butyral resin, to prepare a photoconductor drum C.

(Test production of toner)

Eighty parts by weight of styrene, 20 parts by weight of butyl acrylate, 3 parts of an azo chrome dye (S34, product of Orient), 3 parts by weight of carbon black (Regal 660R, product of Cavot), 3 parts by weight of a polypropylene resin (Biscoru 550P, Sanyo Kasei) and 1 part by weight of a polymerization initiator were mixed and dispersed to obtain a monomer composition. The monomer composition was then charged into 500 parts by weight of distilled water which had dissolved 10 parts by weight of polyvinyl alcohol as a dispersing agent, and the resulting suspension was then heated at 80° C. for polymerization. After cooling, the product was filtered, washed and dried to obtain spherical particles with an average particle size of about 9 μm. Hydrophobic silica (H2000/4, product of Hoechst) was externally added to a coating ratio of 0.8 to obtain a negative charging non-magnetic toner. The tensile rupture stress was measured to be about 0.7 g wt/cm$^2$. The loss permittivity of the toner was about 0.3.

This was then mixed with a silicone resin-coated sheet-like iron powder carrier (product of Hitachi Metals) with an average particle size of approximately 30 μm and an electrical resistance of about $10^5$ Ω·cm, to a toner concentration of 5 wt %, and a printing test conducted with the apparatus shown in FIG. 1 yielded satisfactory images with both photoconductors B and C.

Comparative Example 7

When a printing test was conducted in the same manner as Example 7 except for using photoconductor A, background staining occurred.

Comparative Examples 8 and 9

After melting and kneading 100 parts by weight of a styrene-acryl resin (styrene, butylacryl ratio 8:2), 3 parts by weight of an azo chrome dye (S34, product of Orient), 3 parts by weight of carbon black (Regal 660R, product of Cavot) and 3 parts by weight of a polypropylene resin (Biscoru 550P, Sanyo Kasei), the mixture was pulverized and sorted to obtain particles with an average size of about 9 μm. Hydrophobic silica was externally added to a coating ratio of 0.8 to obtain a non-magnetic toner. The tensile rupture stress was about 2.5 g wt/cm$^2$. The loss permittivity of the toner was about 0.03. In a printing test carried out in the same manner as Examples 7 and 8, considerable background staining was produced with both photoconductors B and C.

Example 9

A sufusion apparatus (product of Nippon Pneumatics) was used for hot air treatment of the pulverized particles obtained in Comparative Example 8. When hydrophobic silica was externally added to a coating ratio of 0.8, the tensile rupture stress was reduced to about 0.9 g wt/cm$^2$. In a printing test carried out in the same manner as Comparative Example 8 using photoconductor B, the background staining was greatly reduced, and satisfactory images were obtained.

Comparative Example 10

The photoconductor drum A was coated with an insulating layer comprising 20 parts by weight of a positive charging nigrosine dye (No. 1, product of Orient) and 80 parts by weight of a polyvinyl butyral resin, to prepare a photoconductor drum D. In a printing test carried out in the same manner as Examples 7 and 8, background fogging occurred.

The results described above are listed in Table 2. They demonstrate that a surface insulating layer which charges at the same polarity as the toner gives more satisfactory printing with non-magnetic toner, but the tensile rupture stress must be low as with magnetic toner. Incidentally, although non-magnetic black toner is used in the example, non-magnetic color toner may of course be used. If magnetic toner is used the effect is increased further.

Example 10

Toner was produced according to Example 5, and mixed with the same type of carrier as in Example 6 to a toner concentration of 15 wt % to prepare a developing agent. A printing test was also conducted with the apparatus shown in FIG. 1. No background fog was found on the resulting printing paper, and satisfactory images were obtained. Also, the apparatus was momentarily shut off during printing and the developing toner image on the photoconductor drum was taken with tape to measure the optical density of the background. As a result, fogging of ΔOD approximately 0.12 was found to occur on the photoconductor drum.

Example 11

In this example the material of the conductive particles was changed.

A developing agent employing toner prepared by external addition of 0.7 wt % of each of the conductive particles listed in Table 3 to the toner of Example 10, was charged into the apparatus mentioned above, and a printing test was conducted in an environment of 25° C. and 50% RH. The fogging was evaluated by taking the developing powder image off the drum using transparent tape and measuring the optical density of the background. The density of the printed sections was measured at the same time.

As a result, as shown in Table 4, the toner charge amount distribution became sharper by the external addition of conductive particles, and as shown in Table 5, all of the toners with externally added conductive particles had less fogging than the toners without externally added conductive particles, and the conductive particles exhibited the effect of the invention regardless of the material.

Comparative Example 11

In this comparative example, an external additive with high resistance was added.

The background fogging was evaluated in exactly the same manner as Example 11, except that the conductive particles of Example 11 were replaced with titanium oxide having an electrical resistance of $10^{10}$ Ω·cm. As a result, fogging of ΔOD approximately 0.15 was found to occur.

Comparative Example 12

In this comparative example, conductive particles with a particle size of 0.6 μm or greater were externally added.

The background fogging was evaluated in exactly the same manner as Example 11, except that the conductive particles of Example 11 (all 0.6 μm or less) were replaced with conductive fine tin oxide particles (resistance 10 Ω·cm or less, product of Mitsui Metals) with a particle size of 1.1 μm. As a result, fogging of ΔOD approximately 0.12 occurred.

Example 12

In this example, the amount of externally added conductive particles was changed.

The amount of external addition of the conductive particles EC-300 investigated in Example 11 was changed to about 1 wt %. This toner was used to evaluate fogging under an environment of 25° C., 50% RH and 10° C., 10% RH, according to the same method as in Example 11. The transfer efficiency was also evaluated at 25° C., 50% RH.

As a result, as shown in Table 6, a sufficient fogging-reducing effect was obtained with 1 wt % or less external addition of the conductive particles. The anti-fogging effect was particularly notable under the environment of low temperature and low humidity.

Comparative Example 13

In this comparative example, the conductive particles were externally added in an amount of 1 wt % or greater.

The amount of EC-300 in the external additive was 1 wt % or greater as in Example 12. This resulted in a transfer efficiency of 80% or lower.

TABLE 1

| Toner | $\sigma_T$ (g wt/cm$^2$) | Coating ratio | Loss permittivity | Print quality | Remarks |
|---|---|---|---|---|---|
| Example 1 | 0.7 | 1 | 0.19 | ○ | |
| Example 2 | 0.75 | 0.6 | 0.19 | ○ | |
| Comp. Ex. 1 | 1.5 | 0.3 | 0.19 | x | background staining reduced |
| Comp. Ex. 2 | 0.7 | 1.5 | 0.19 | Δ | fixing property |
| Comp. Ex. 3 | 1.3 | 0.8 | 0.21 | x | background staining |
| Comp. Ex. 4 | 2.7 | 0.8 | 0.05 | xx | notable staining |
| Example 3 | 1.0 | 0.8 | 0.17 | ○ | |
| Example 4 | 0.6 | 0.8 | 0.48 | ○ | |
| Comp. Ex. 5 | 1.1 | 0.8 | 0.45 | Δ | slight staining |
| Example 5 | 0.9 | 0.8 | 0.45 | ○ | |

TABLE 2

| | Photoconductor | $\sigma_T$ of toner (g wt/cm$^2$) | Print quality | Remarks |
|---|---|---|---|---|
| Example 7 | B | 0.72 | ○ | cyanoethylated polysaccharide coat |
| Example 8 | C | 0.72 | ○ | negative charged dye coat |
| Comp. Ex. 7 | A | 0.72 | x | no surface coat |
| Comp. Ex. 8 | B | 2.5 | x | |
| Comp. Ex. 9 | C | 2.5 | x | |
| Example 9 | B | 0.93 | ○ | |
| Comp. Ex. 10 | D | 0.72 | x | positive charged dye coat |

TABLE 3

Conductive particles

| Name | Manufacturer | Material | Particle size (μm) | Electrical resistance (Ω · cm) |
|---|---|---|---|---|
| Mogall L | Cavot | carbon | 0.03 | — |
| BL200 | Titan Kogyo | magnetite | 0.2 | $10^2$–$10^4$ |
| Pastran IV | Mitsui Metals | conductive barium sulfate | 0.4 | 10 |
| EC300 | Titan Kogyo | conductive titanium oxide | 0.2–0.3 | 10 |
| ITO | Mitsui Metals | tin oxide based composite oxide | 300Å | — |

* = hydrophobically treated product

TABLE 4

Relationship between amount of externally added conductive particles and charge amount distribution

| External additive | Amount EC-300 (wt %) | Q/D (−fC/10 μm) | S.D. |
|---|---|---|---|
| H2000/4 | 0 | 2.2 | 0.6 |
| (coating ratio = 0.7) | 0.1 | 2.0 | 0.7 |
| | 0.3 | 1.8 | 0.7 |
| | 0.5 | 1.9 | 0.5 |
| | 0.7 | 1.6 | 0.3 |

Note:
Measuring apparatus -- Epping q-Meter

TABLE 5

Effect of conductive particles in Example 11 (conductive particles externally added to toner of Example 10)

| External additive | | Print density | Fogging density | Loss permittivity | Developing agent resistance |
|---|---|---|---|---|---|
| Example 10 | | 1.32 | 0.12 | 0.45 | $7 \times 10^9$ |
| Mogall L | 0.7% | 1.25 | 0.02 | 0.75 | $5 \times 10^9$ |
| BL200 | 0.7% | 1.30 | 0.02 | 0.48 | $6 \times 10^9$ |
| Pastran IV | 0.7% | 1.26 | 0.02 | 0.51 | $7 \times 10^9$ |
| EC300 | 0.7% | 1.26 | 0.01 | 0.54 | $5 \times 10^9$ |
| ITO | 0.7% | 1.27 | 0.01 | 0.72 | $5 \times 10^9$ |

TABLE 6

Effect of amount of externally added conductive particles in Example 12 and comparative Example 13 (conductive particles externally added to toner of Example 10)

| | External additive | 25° C., 50% RH Print density | 25° C., 50% RH Drum density | 10° C., 10% RH Print density | 10° C., 10% RH Drum density | Transfer efficiency (%) |
|---|---|---|---|---|---|---|
| | Example 10 | 1.32 | 0.12 | 1.11 | 0.77 | 93 |
| Ex. 12 | EC-300 0.1% | 1.27 | 0.04 | 1.14 | 0.38 | — |
| | EC-300 0.3% | 1.24 | 0.01 | 1.12 | 0.07 | — |
| | EC-300 0.5% | 1.15 | 0.01 | 1.14 | 0.01 | 91 |
| | EC-300 0.7% | 1.09 | 0.01 | 1.09 | 0.02 | — |
| | EC-300 0.9% | 1.04 | 0.01 | 1.08 | 0.02 | 83 |
| Comp. | EC-300 1.5% | 0.97 | 0.01 | 0.95 | 0.01 | 72 |
| Ex. 13 | EC-300 2.0% | 0.92 | 0.01 | 0.81 | 0.02 | 50 |

As explained above, according to the present invention it is possible to reduce background fogging of print in a recording system which performs development almost simultaneously with image exposure from the back side of the photoconductor. The process of the invention employs insulative toner, and therefore the transfer efficiency is not greatly reduced, while higher image quality is provided in the back-light process.

We claim:

1. An image forming process, using an apparatus comprising a photoconductor formed by successive laminations of a conductive layer of a light-transmittable material and a photoconductive layer on a substrate, a light source arranged on the substrate side of said photoconductor, and a developing roll arranged on the photoconductive layer side of said photoconductor, said process comprising the steps of:

relatively moving said photoconductor with respect to said developing roll, by which a developing agent present around said developing roll contacts said photoconductor in an area of said photoconductor near said developing roll;

electrically charging said photoconductor through said developing agent in said area by applying a voltage between said photoconductor and said developing roll;

exposing said photoconductor in said area with a light image by said light source to form a latent image on said photoconductor;

developing said latent image on said photoconductor with said developing agent in said area to form a developed image on said photoconductor; and transferring said developed image from said photoconductor to a recording medium;

wherein said developing agent comprises an insulative toner and a conductive carrier, said insulative toner being a non-magnetic toner, the tensile rupture stress of a layer of the insulative toner powder is 0.1 to 1 gf/cm$^2$, and said photoconductor further comprises a surface insulating layer on the surface thereof, said surface insulating layer further containing a compound which charges to the same polarity as the toner with respect to said carrier.

2. The image forming process of claim 1, characterized in that insulative organic or inorganic fine particles are externally added to said insulative toner, and the coating ratio of the fine particles on the toner surface is in a range of 0.5 to 1.

3. The image forming process of claim 1, characterized in that the volume resistance of said developing agent is $10^{10}$ Ω·cm or lower.

4. The image forming process of claim 1, characterized in that said insulative toner further comprises conductive particles externally added to said insulative toner so that said toner is semi-conducting.

5. The image forming process of claim 4, wherein the electrical resistance of said conductive particles is $10^5$ Ω·cm or lower.

6. The image forming process of claim 4, wherein the particle size of said conductive particles is 0.6 μm or less.

7. The image forming process of claim 4, characterized in that the loss permittivity of said insulative toner is 0.1 to 1.

8. The image forming process of claim 4, characterized in that said conductive particles comprise at least one selected from the group consisting of carbon, tin oxide-based composite oxide, conductive titanium oxide in which the surface of titanium oxide is treated with a tin oxide-based semiconductor, and conductive barium sulfate in which the surface of barium sulfate is treated with a tin oxide-based semiconductor.

9. The image forming process of claim 4, wherein said conductive particles are added in an amount of 1 wt % or less with respect to the weight of the toner.

10. The image forming process of claim 4, wherein said conductive particles are magnetite added in an amount of 1 wt % or less with respect to the weight of the toner.

* * * * *